United States Patent [19]

Moore

[11] 4,139,120

[45] Feb. 13, 1979

[54] VENDING APPARATUS FOR NEWSPAPERS AND ANALOGOUS ARTICLES

[75] Inventor: Harry O. Moore, Charlotte, N.C.

[73] Assignee: Chris Combis, Charlotte, N.C.; a part interest

[21] Appl. No.: 747,717

[22] Filed: Dec. 6, 1976

[51] Int. Cl.[2] ..... B65H 3/22

[52] U.S. Cl. ..... 221/213; 221/244

[58] Field of Search ..... 221/213–216, 221/259, 91, 244; 271/19, 24, 42

[56] References Cited

U.S. PATENT DOCUMENTS 3,708,087 1/1973 Schonthal ..... 221/244

*Primary Examiner*—Stanley H. Tollberg

*Attorney, Agent, or Firm*—Bell, Seltzer, Park & Gibson

[57] ABSTRACT

The apparatus comprises a platform for supporting a substantially vertical stack of articles, such as newspapers, magazines and the like, with the articles inclined downwardly and forwardly. Article hold-back apparatus, positioned alongside the platform, extends upwardly therefrom and is adapted to engage and extend across forward edges of the articles in the stack to restrain the same from forward sliding movement from the stack, and a carriage mounted for substantially vertical movement alongside the forward edges of the articles in the stack, is operatively connected to the article hold-back apparatus to successively effect disengagement of the article hold-back apparatus with the uppermost article in the stack. Stack height sensing apparatus is carried by the carriage and includes a presser member adapted to engage and rest upon successive uppermost articles in the stack while serving for in turn restraining the carriage against downward movement, and article discharge apparatus is carried by the carriage for engaging the uppermost article in the stack and for slidingly moving the uppermost article rearwardly out of engagement with the presser member so as to permit the presser member to drop downwardly onto the next article to be dispensed and thereby effect a corresponding lowering of the carriage to gravitationally dispense the uppermost article from the stack.

7 Claims, 7 Drawing Figures

VENDING APPARATUS FOR NEWSPAPERS AND ANALOGOUS ARTICLES

Among recent developments in apparatus for dispensing articles, such as newspapers and the like, is the apparatus disclosed in my own U.S. Pat. No. 3,907,160, dated Sept. 23, 1975, and wherein an article supporting means supports a stack of superposed articles inclined downwardly and forwardly at an angle for facilitating dispensing the articles, one at a time, from the stack. In order to dispense successive uppermost articles from the stack, an article hold-back means positioned in front of the stack moves downwardly in a predetermined stepwise manner for successively positioning the restraining means out of engagement with successive uppermost articles in the stack to permit forward movement of each successive uppermost article and to thereby effect dispensing of the successive unrestrained uppermost articles.

It is an important object of this invention to improve upon apparatus of the type disclosed in my said U.S. Pat. No. 3,907,160 by providing an arrangement permitting the gravitational dispensing of successive articles of any thickness from a substantially vertical stack of contacting articles by sensing the height of the stack of articles and effecting a lowering of the article hold-back means in accordance with the thickness of the successive articles dispensed.

According to the preferred embodiment of the invention, the vending apparatus comprises means for supporting a substantially vertical stack of the articles with the articles inclined downwardly and forwardly, with article hold-back means positioned alongside the supporting means and extending upwardly therefrom and adapted to engage and extend across corresponding forward edges of the articles in the stack to restrain the same from forward sliding movement from the stack. Carriage means, mounted for substantially vertical movement alongside the forward edges of the stack of articles, is operatively connected to the article hold-back means to successively effect disengagement of the article hold-back means with the uppermost article in the stack, and stack height sensing means is carried by the carriage means and includes a presser member adapted to engage and rest upon successive uppermost articles in the stack while serving for in turn restraining the carriage means against downward movement. Article discharge means carried by the carriage means engages the uppermost article in the stack for slidingly moving such uppermost article rearwardly out of engagement with the aforementioned presser member so as to permit the presser member to drop downwardly onto the next article to be dispensed and thereby effect a corresponding lowering of the carriage means to gravitationally dispense the uppermost article from the stack.

Some of the objects of the invention having been stated, other objects will appear as the description proceeds when taken in connection with the accompanying drawings, in which FIG. 1 is a perspective view of a vending apparatus embodying the present invention;

Referring more specifically to the drawings, the apparatus comprises a cabinet or a housing 10 carried by a suitable frame 11 which supports, within housing 10, a supporting means 12 for a substantially vertical stack of articles A, such as newspapers, magazines or the like. Supporting means 12 may take the form of a downwardly and forwardly inclined shelf or platform so positioned that the articles in the stack A are inclined downwardly and forwardly, and as preferred, the articles are stacked in juxtaposed or contacting relationship. The rear wall of housing 10 is in the form of a hinged door 13 permitting ready access to the interior of housing 10 for loading the articles therein.

Figure 3:
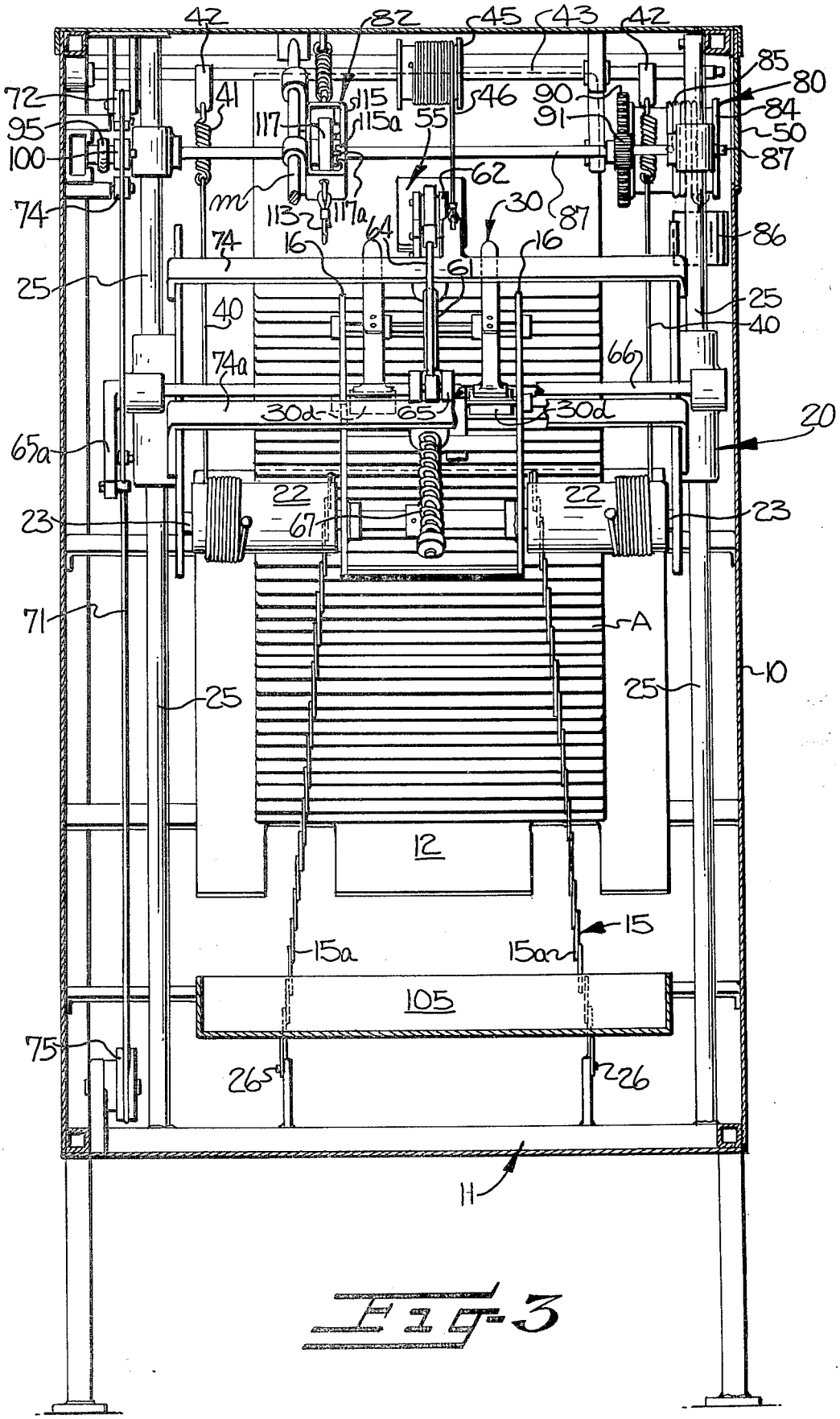
FIG. 3 is a transverse vertical sectional view through the apparatus taken substantially along line 3—3 in FIG. 2.

Article hold-back means is positioned alongside the supporting means 12 and extends upwardly therefrom and is adapted to engage and extend across corresponding forward edges of the articles in the stack A to restrain the same from forward sliding movement from the stack. The article hold-back means may take the form of chain means 15 and cooperating slide members 16 to which a carriage means 20 is operatively connected to successively effect disengagement of the article hold-back means with the uppermost article in the stack A. Chain means 15 comprises a pair of laterally spaced chains **15*a* whose links are preferably formed of relatively thin, rigid, flat material so that each successive link in each chain 15*a* may be offset with respect to the next adjacent link and so that the chains 15*a* may extend upwardly in converging relationship as best shown in FIG. 3 and may be wound about respective drums or rollers 22, or other suitable rotatable means, in a spiral or helical manner. The drums 22 are fixed on a shaft 23 rotatably supported by opposing side frame members 24 of carriage means 20**.

Carriage means 20 is mounted within housing 10 for substantially vertical movement alongside the forward edges of the articles in the stack A. Accordingly, the side frame members 24 of carriage means 20 are guided for substantially vertical sliding movement on a pair of laterally spaced upright guide posts 25 (FIGS. 3 and 4) suitably secured to the frame 11.

The lower ends of the hold-back chains **15*a* are suitably connected to the frame 11 below the forward portion of the stack suporting means 12, as at 26, so that the hold-back chains 15*a* extend past the forward portion of supporting means 12 and upwardly therefrom for engaging and extending across corresponding forward edges of the articles in the stack A to restrain the same from forward sliding movement from the stack. The upper end portions of the hold-back chains 15*a* are suitably attached to the respective drums 22, and each of the chains 15*a* is especially constructed so that it will not bow or be pushed forwardly excessively between its anchorage point 26 at the lower end thereof and the respective drum 22 by the weight or pressure of the articles A against the rear surface thereof. Accordingly, it will be observed in FIG. 2 that the upper end of each link of the chain 15*a*** there shown is provided with a relatively small extension 15*b* which is adpated to engage a lateral projection or pin 15*c* on the side of the next adjacent link thereabove. Thus, the projections 15*b* limit the extent of relative outward or forward pivotal movement between adjacent links of each chain 15*a*, while permitting the links to pivot into substantially side-by-side relation when pivoted in the opposite direction inwardly toward each other.

Figure 4:
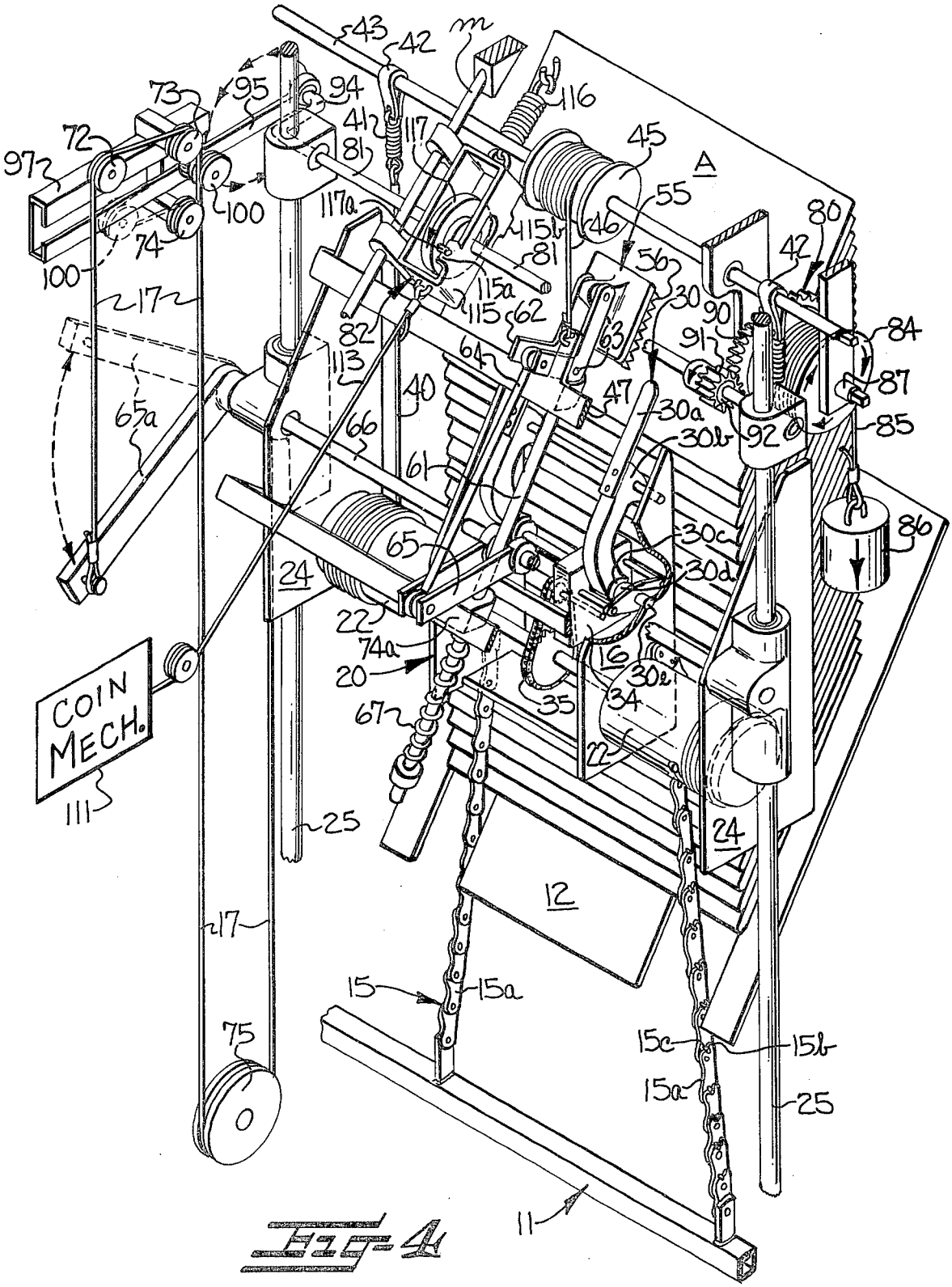
FIG. 4 is a somewhat schematic, fragmentary perspective view of essential operating mechanisms of the apparatus.

Referring now to the article hold-back guide members 16, it will be observed in FIGS. 3 and 4 that they are suitably supported by carriage means 20 and are positioned between the upper portions of the two article hold-back chains 15*a* in laterally spaced relation to each other. Guide members 16 have substantially straight, elongate and vertically extending rear faces or edges thereon, preferably of a low-friction synthetic plastic material, such as Teflon. Such rear edges of guide members 16 are so positioned that the upper end portions thereof are adapted to be engaged by a forward edge portion of at least the uppermost article in the stack A.

A stack height sensing means 30 carried by the carriage means 20 normally sustains carriage means 20 in an elevated position such that the upper ends of guide members 16 occupy the aforementioned position to restrain against forward movement the uppermost article in the stack. The stack height sensing means 30 includes one or more presser members 30*a*, two of which are illustrated in FIGS. 3 and 4. Presser members 30*a* are disposed in tranversely spaced relationship between the article hold-back guide members 16, and the presser members 30*a* are adapted to engage and rest upon successive uppermost articles in the stack and serve, for in turn restraining carriage means 20 against downward movement. To this end, presser members 30*a* are suitably secured to the rear upper portions of respective brake members or arms 30*b* having brake bands 30*c* on their lower ends which normally engage respective brake drums 30*d* fixed on a shaft 30*e*. Thus, brake bands 30*c* and brake drums 30*d* constitute brake means which is rendered effective to restrain carriage means 20 against downward movement whenever the pressure of the presser members 30*a* engaging and resting upon the respective uppermost article in the stack applies an effective force to the brake bands 30*c* against the respective brake drums 30*d*. In this instance, shaft 30*e* is connected to a gear box or gear reduction unit 34 having a lower or output portion connected to shaft 23 by means of a suitable chain and sprocket arrangement 35.

In order to rotate drums 22 in the desired direction and at the desired rate for taking up the hold-back chains 15*a* whenever carriage means 20 is permitted to gravitate downwardly, corresponding ends of a pair of cables or elongage pliable elements 40 are attached to the outer portions of the respective drums 22. The cables 40 are wound about the drums 22 several times and then extend upwardly and are connected, by means of respective tension springs 41 and strap members 42, to a substantially horizontally disposed shaft 43 journaled in frame 11 within the upper portion of housing 10.

Shaft 43 is utilized for resetting the apparatus when a fresh stack of articles A is placed in the apparatus. Accordingly, a drum 45 secured on shaft 43 has one end of a cable 46 secured thereto. Cable 46 is wrapped around drum 45 several times and the other end of cable 46 is attached to an upper or rear transverse frame member 47 of carriage means 20. One end of shaft 43 may be of polygonal cross-section for the reception of a suitable hand-crank, not shown, for winding up the cable 46 on the drum 45 to manually raise the carriage means 20 to the desired elevation during the resetting of the apparatus. The aforementioned hand-crank may be inserted in housing 10 through a suitable opening in one of the side walls thereof, which opening is closed by a suitable cover 50 (FIGS. 1 and 3) following the resetting of the apparatus.

The apparatus includes a new and novel article discharge means, broadly designated at 55, which is carried by carriage means 20 for engaging the uppermost article in the stack and for slidingly moving the uppermost article rearwardly out of engagement with presser members 30*a* so as to permit the presser members 30*a* to drop downwardly onto the next article to be dispensed and thereby effect a lowering of carriage means 20 to gravitationally dispense the uppermost article from the stack. As shown, the article discharge means 55 may take the form of a pusher means 56 overlying the uppermost article in the stack A, and having a resilient or otherwise suitably formed lower surface such that the pusher means 56 may frictionally or piercingly engage and apply a rearward force to the uppermost article in the stack of sufficient magnitude to slidingly move the respective article rearwardly out of engagement with presser members 30*a*.

Figures 1, 2:
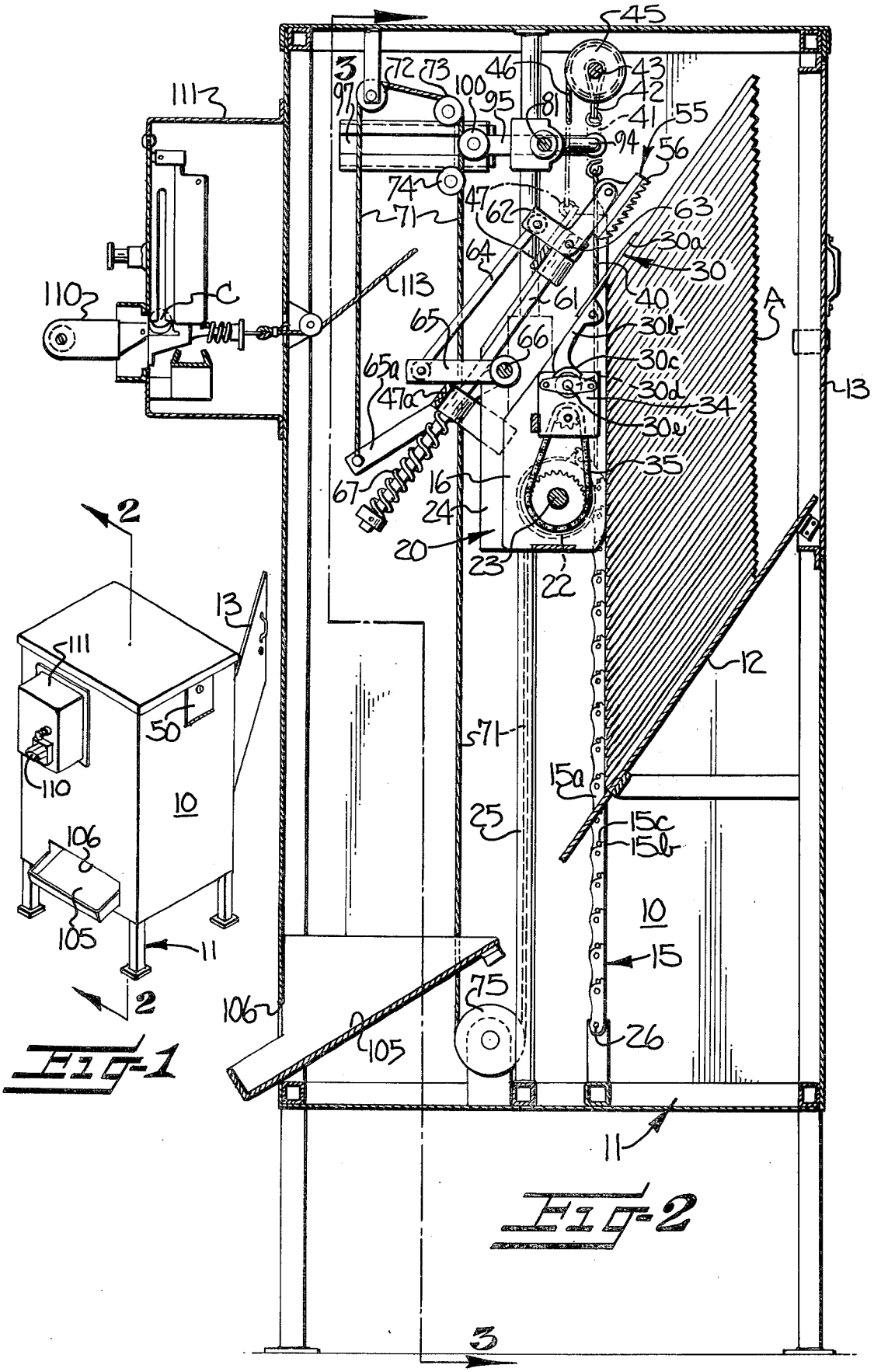
FIG. 2 is an enlarged vertical sectional view through the apparatus taken substantially along line 2—2 in FIG. 1, and showing the various mechanisms thereof occupying rest positions.

As observed in FIG. 2, pusher means 56 normally occupies inactive position spaced above the uppermost article in the stack, and a linkage means is connected to the pusher means 56. As will be later described, a normally inactive drive means is drivingly connected to the aforementioned linkage means, and a manually operable control means for the drive means is effective to momentarily activate the drive means for driving the linkage means and to thereby cause the pusher means 56 to move into engagement with the uppermost article in the stack and to slidingly move such uppermost article rearwardly out of engagement with the presser members 30*a*. To this end, it will be observed in FIGS. 2 and 4 that the linkage means comprises an elongate bar or plunger means 61 which may extend forwardly and rearwardly in substantially parallel relation to the inclined plane of the individual articles in the stack A and is suitably guided for longitudinal movement in the upper frame member 47 of carriage means 20 as well as in additional, lower or forward transverse frame member 47*a* of carriage 20.

An oscillatable carrier means 62, shown in the form of a bell crank in FIG. 2, is supported on the rear portion of plunger means 61 for movement about a pivotal axis 63 extending substantially transversely of plunger means 61. Pusher means 56 is attached to carrier means 62, as by being pivotally connected thereto, in such a manner that the pusher means 56 extends rearwardly of the pivotal axis 63 of carrier means 62.

Thrust means, in the form of a link 64, is pivotally connected to carrier means 62 at a point above pivotal axis 63 of carrier means 62. Link 64 extends downwardly and forwardly from carrier means 62 and its rear portion is pivotally connected to a crank means 65. Crank means 65 extends forwardly from link 64 and is fixedly mounted on a rocker shaft 66 journaled in one of the side frame members 24 of carriage means 20. Biasing means, in the form of a compression spring 67, is provided on the lower or forward portion of plunger means 61 for normally urging the same downwardly and forwardly so that carrier means 62 is normally positioned against the transverse frame member 47 of carriage means 20, and pusher means 56 then occupies the inactive position shown in FIG. 2.

As best shown in FIG. 4, shaft 66 has an additional crank means 65*a* thereon to which one end of a pliable element or cable 71 is attached. As will be presently described, cable 71 serves, along with crank means 65, 65*a*, as means for imparting a rearward motion to the thrust means or link 64, causing the carrier means 62 and pusher means 56 to pivot on the axis 63 until pusher means 56 engages the uppermost article therebeneath, and so that the plunger means 56 then slidingly moves the respective article rearwardly out of engagement with the presser members 30*a* of the height sensing means 30. Accordingly, cable 71 extends upwardly from crank means 65*a* and over and in engagement with a plurality of pulleys 72, 73, and 74 collectively constituting an upper guide means. Pulleys 73, 74 are spaced rearwardly of pulley 72, and the cable 71 extends rearwardly of pulleys 73, 74 and downwardly therefrom and then partially around a pulley 75 constituting a lower guide means. From the pulley 75, cable 71 then extends upwardly and is suitably secured to the adjacent side frame member 24 of carriage means 20.

Drive means for imparting a rearward motion to thrust means or link 64 is broadly designated at 80 (FIG. 3) and may include any suitable motive means for rotating a crank shaft 81 a predetermined amount in response to operation of a manually operable control means 82 to be later described. It is preferred that the motive means does not rely upon any external power source or combustible material for the operation thereof. Accordingly, the motive means is shown in the form of a winch, in the upper right-hand portion of FIG. 4, comprising a reel or drum 84 about which a cable 85 is wound, with one end of the cable being connected to the drum 84 and the other end being attached to a weight means 86 suspended from the cable 85 within housing 10.

Drum 84 is fixed on a shaft 87 adjacent and below shaft 43 and having its outer end shaped for receiving a suitable hand-crank for winding up the cable 85 on the drum 84 during a resetting operation. Shaft 87 is rotatably mounted in frame 11 within housing 10 adjacent the access opening heretofore described as being covered by cover 50, and shaft 87 has a gear 90 in fixed axial relation thereto which meshes with a smaller gear or pinion 91 mounted on crank shaft 81 by means of an intervening one-way clutch means 92. Clutch means 92 may be of any well-known construction and may, for example, be of the type indicated at 175 in FIG. 17 of my said U.S. Pat. No. 3,907,160.

One-way clutch means 92 is so arranged that, when shaft 81 is free to rotate, the torque being applied to drum 84 by cable 85 and weight means 86 will cause gears 90, 91 to transmit rotation through clutch means 92 to shaft 81 in a forward direction (counterclockwise in FIGS. 2 and 4–7). One end of shaft 81 has a crank or eccentric portion 94 thereon on which one end portion of a link or connecting rod 95 is pivotally supported. As shown in the upper portions of FIGS. 2 and 4, link 95 extends forwardly from crank shaft 81 and is suitably guided at its forward portion for substantially linear forward and rearward motion in a guide member 97 suitably secured to the adjacent wall of housing 10.

Figure 6:
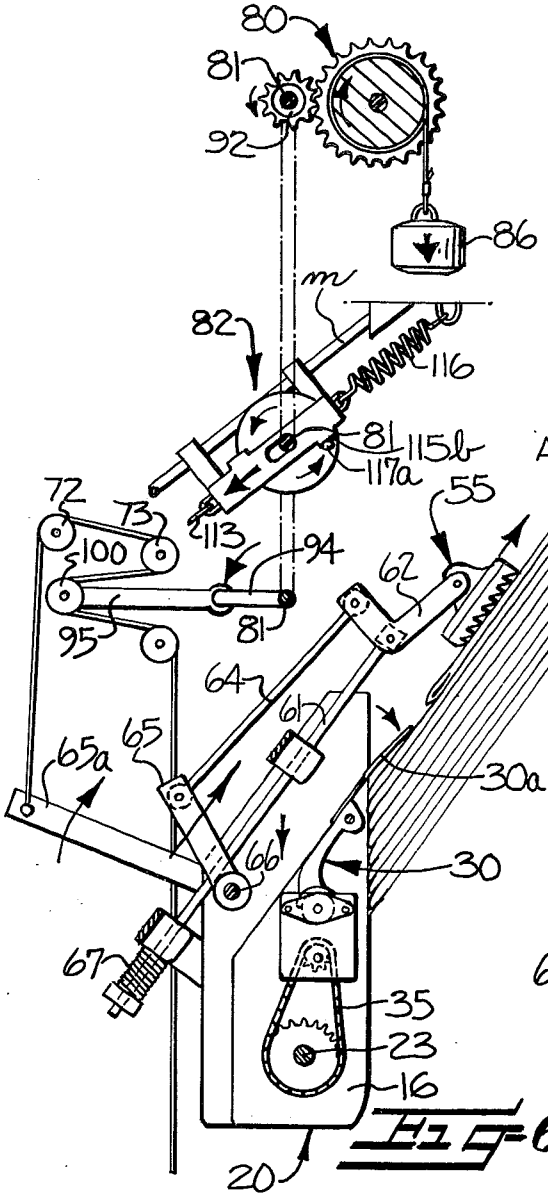
Figure 5:
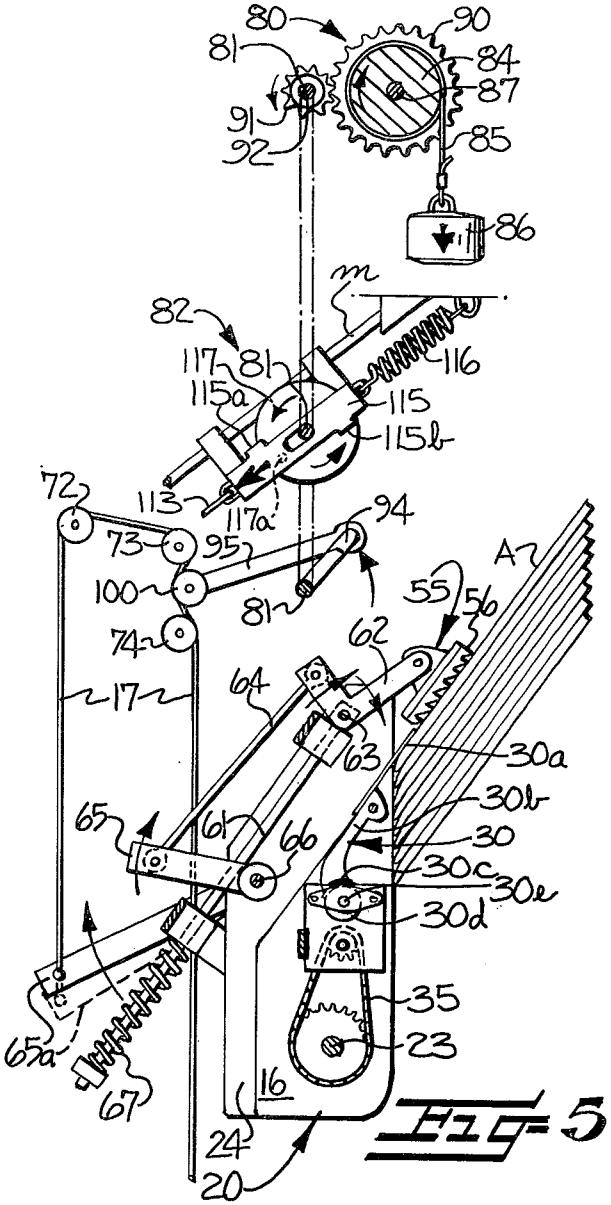

A loop-forming member, in the form of a pulley 100, is carried by the forward portion of connecting rod or link 95 and is arranged to engage a portion of cable 71 extending across the opening defined between the pulleys 73, 74. Thus, with shaft 81 normally at rest in the position shown in FIGS. 2 and 4, upon activation of the drive means 80 by releasing the shaft 81 for rotation in a manner to be later described, pulley 100 moves forwardly through the opening defined between pulleys 73, 74, thus forming a loop or off-set portion in cable 71 as shown in FIGS. 5 and 6. It is apparent that this foreshortens cable 71, thereby moving the crank means 65, 65*a* upwardly and rearwardly in a clockwise direction in FIGS. 2, 5 and 6.

In so doing, the consequent rearward movement of line 64 initially imparts pivotal movement to carrier means 62 in a clockwise direction about pivot 63. Thus, the pusher means 56 of the article discharge means 55 is moved downwardly against the uppermost article in the stack A. When the pressure of pusher means 56 against the uppermost article subsequently becomes sufficient to overcome the static resistance of spring means 67, then plunger means 61, carrier means 62 and pusher means 56 are moved rearwardly by link 64 so that plunger means 56 then slidingly moves the respective article rearwardly of and out of engagement with presser members 30*a*, permitting the presser members to move downwardly to rest upon the next succeeding uppermost article in the stack A as shown in FIG. 6.

As the uppermost article in the stack A is moved rearwardly of presser member 30*a*, it is apparent that brake arms 30*b* are momentarily moved in a clockwise direction in FIG. 5 to the position of FIG. 6, thus momentarily releasing the brake means 30*c*, 30*d* and permitting rotation of shaft 23 and drums 22, to in turn, permit carriage means 20 to drop downwardly until the brake means 30*c*, 30*d* is again effective to arrest and restrain further downward movement of carriage means 20 by virtue of the presser members 30*a* pressing against the next succeeding uppermost article in the stack A.

Figure 7:
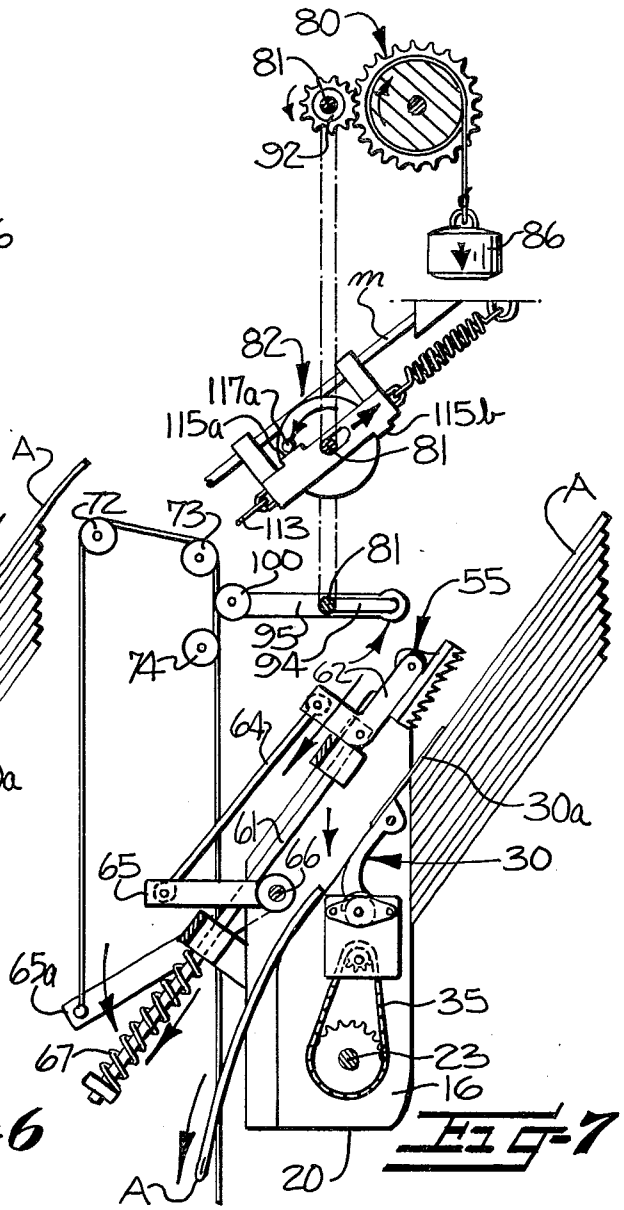
FIGS. 5, 6 and 7 are fragmentary view schematically illustrating successive stages in the operation of the carriage means and the article discharge means carried by the carriage means.

It is apparent that the arrangement of the cable 71 is such as to permit crank means 65*a* to move downwardly with carriage means 20 without disturbing the operation of the loop forming pulley 100 in its formation of and subsequent releasing of the loop in cable 71. Following the formation of the loop in cable 71 in the manner heretofore described, and the consequent movement of pusher means 56 to its rearmost position substantially as shown in FIG. 6, it is apparent that pulley 100 moves rearwardly in FIGS. 2, 4 and 6 to return to its position of rest as shown in FIG. 7, thus permitting spring means 67 to return the associated linkage means and pusher means 56 to their normally inactive positions. In so doing, it can be appreciated that pusher means 56 exerts a downward and forward pressure on the uppermost article in the stack then being engaged thereby, thus aiding in the gravitational movement of such uppermost article forwardly over the then lowered presser members 30*a*.

Of course, upon the forward portion of carrier means 62 moving into engagement with the transverse frame member 47 of carriage means 20, rearward movement of plunger means 61 ceases so that link 64 then moves carriage means 62 in a counterclockwise direction about pivot 63 to raise pusher means 56 and return the same to the inactive position shown in FIGS. 2 and 7. The thus unrestrained article is then gravitationally dispensed by sliding over the brake arms 30*b* and the downwardly and forwardly inclined upper edges of guide members 16 to drop onto a suitable chute 105 partially positioned within the lower portion of housing 10 and extending outwardly therefrom through an opening 106 in the front wall of housing 10 to be picked up by the customer.

The manual control for the drive means may be of the type substantially as disclosed in my said U.S. Pat. No. 3,907,160 suitably modified to accommodate the arrangement of the drive means peculiar to the present apparatus. As shown in FIG. 2, the manual control includes a normally locked hand-operated actuator 110 of the usual type which is released upon a suitable coin or coins C being properly positioned in the lower portion of a coin mechanism 111 which need not be described in detail, as it may be of the type described in my said U.S. Pat. No. 3,907,160.

The locking and releasing mechanism of the coin mechanism 111 is of a well-known type requiring that the hand-operated actuator 110 must be pulled outwardly a predetermined distance and then must be returned to substantially its original position of rest in order to effect a complete dispensing operation. When the hand-operated actuator 110 is pulled forwardly, a cable or link 113 connected thereto is moved forwardly therewith for operating the manually operable control means 82 shown in the upper central portion of FIG. 4.

To this end, the rear end of cable 113 is attached to a composite latch means 115 guided for forward and rearward movement on means M carried by the top wall of housing 10 (FIGS. 3–7) and penetrated by crank shaft 81 for limiting the forward and rearward movement of latch means 115. Latch means 115 is biased toward a predetermined rearward position by a suitable spring means 116. Suitably secured on shaft 81 adjacent latch means 115 is a rotor 117 having a radially offset abutment or projection **117*a* thereon adapted to alternatively engage a pair of restraining abutments or latch members 115*a*, 115*b* on composite latch means 115**.

Latch members **115*a*, 115*b* straddle shaft 81 and are spaced radially outwardly from shaft 81 sufficiently so that the distance between latch members 115*a*, 115*b* is greater than the diameter of the circular path traced by abutment 117*a* during a revolution of shaft 81 and rotor 117. However, abutments 115*a*, 115*b* are so positioned that, whenever either of the abutments 115*a*, 115*b* is positioned radially outwardly of the path of the abutment 117*a*, the other of the abutments 115*a*, or 115*b* is positioned in the path of the abutment 117*a*. When the apparatus is at rest, abutment 115*a* is in the path of and is being engaged by the abutment 117*a* on rotor 117, thus restraining rotor 117 and shaft 81 from forward rotation in the counterclockwise direction in FIGS. 4–7 and in opposition to the torque being applied to shaft 81 by the weight means 86**.

When the composite latch means 115 is moved forwardly in opposition to spring 116 by an operator imparting forward movement to the actuator 110 of FIG. 2, abutment **115*a* is moved out of engagement with abutment 117*a*, thus releasing rotor 117 and crank shaft 81 and permitting rotation thereof by weight means 86. The rotor 117 and crank shaft 81 then rotate a predetermined angular distance; e.g., about one-half a revolution, whereupon the abutment 117*a* moves into engagement with and is restrained from further movement by the abutment 115*b* (see FIG. 6). This prevents the uppermost article in the stack A from being released and dispensed from the stack until the operator releases the actuator 110 (FIG. 2) and the actuator returned to its normal position of rest, as in FIG. 7**.

As the actuator returns to the latter position, it is apparent that spring means 116 returns composite latch means 115 to its normal rest position, thereby moving abutment **115*b* out of the path of abutment 117*a* and moving abutment 115*a* into the path of abutment 117*a*, and permitting the rotor 117 and crank shaft 81 to complete the corresponding revolution thereof to return the connecting rod 95 and its loop forming pulley 100 to the rest position shown in FIGS. 2, 4 and 7. As heretofore described, as pulley 100 and connecting rod 95 return to their positions of rest, pusher means 56 also returns to its position of rest to release the corresponding uppermost article from the stack A to be gravitationally dispensed therefrom onto chute 105 (FIG. 2**).

Since the cable 85 of FIG. 4 is paid out from the drum 84, it follows that weight means 86 may be positioned quite close to the bottom of housing 10 by the time that the last article in the stack A is discharged therefrom. Accordingly, in the resetting operation, not only is carriage means 20 returned to the raised position in the manner heretofore described through the manual rotation of shaft 43, but the weight means 86 also is returned to a raised position by manual rotation of crank shaft 81 in the counterclockwise direction in FIG. 4. The drum 84 is rotated in such counterclockwise direction without rotating crank shaft 81, due to the presence of the one-way clutch means 92 between pinion 91 and shaft 81.

It is thus seen that I have provided an improved apparatus for dispensing articles, such as newspapers, magazines and the like, wherein means 12 is provided for supporting a substantially vertical stack of the articles A with the articles inclined downwardly and forwardly, and wherein article hold-back means 15, 16 positioned alongside the supporting means 12 and extending upwardly therefrom is adapted to engage and extend across corresponding forward edges of the articles in the stack to restrain the same from forward sliding movement from the stack. Carriage means 20, being mounted for substantially vertical movement alongside the forward edges of the articles in the stack, is operatively connected to the article hold-back means 15, 16 to successively effect disengagement of the article hold-back means with the uppermost article in the stack, and the stack height sensing means 30, carried by the carriage means 20, includes at least one presser member **30*a* which is adapted to engage and rest upon successive uppermost articles in the stack and serves for in turn restraining carriage means 20 against downward movement. Additionally, it can be seen that I have provided article discharge means 55 carried by carriage means 20 for engaging the uppermost article in the stack A and for slidably moving such uppermost article rearwardly out of engagement with the presser member or members 30*a* so as to permit the presser member or members to drop downwardly onto the next article to be dispensed and thereby effect a corresponding lowering of the carriage means 20** to gravitationally dispense the uppermost article from the stack.

In the drawings and specification there has been set forth a preferred embodiment of the invention and, although specific terms are employed, they are used in a generic and descriptive sense only and not for purposes of limitation.

That which is claimed is:

1. Apparatus for dispensing articles, such as newspapers, magazines and the like, comprising means for supporting a substantially vertical stack of the articles with the articles inclined downwardly and forwardly, article hold-back means positioned alongside said supporting means and adapted to engage and extend across corresponding forward edges of the articles in the stack to restrain the same from forward sliding movement from the stack, carriage means mounted for substantially vertical movement alongside the forward edges of the stack of articles and being operatively connected to said article hold-back means and adapted to move downwardly upon each successive uppermost article being dispensed from the stack, stack height sensing means carried by said carriage means and including a presser member adapted to engage and rest upon successive uppermost articles in the stack and serving for in turn restraining the carriage means against downward movement, and article discharge means carried by said carriage means for engaging the uppermost article in the stack and for slidingly moving the uppermost article rearwardly a predetermined distance out of engagement with said presser member so as to permit said presser member to drop downwardly onto the next article to be dispensed and thereby effect a lowering of said carriage means to gravitationally dispense the uppermost article from the stack over the presser member.

2. Apparatus according to claim 1 including brake means operatively associated with said presser member and said carriage means and being operable to aid in restraining said carriage means against downward movement while said presser member is resting upon the uppermost article in the stack.

3. Apparatus according to claim 1 wherein said article discharge means comprises pusher means normally spaced above the uppermost article in the stack, means operatively connected to said pusher means for moving the same downwardly and rearwardly to engage and move the uppermost article rearwardly of said presser member, and said last-named means also being operable to return said pusher means to its normal position spaced above the uppermost article to thereby release the same for being gravitationally dispensed from the stack.

4. Apparatus according to claim 1 wherein said article discharge means comprises cyclically movable pusher means normally spaced from the top of the stack and movable downwardly and rearwardly and then forwardly and upwardly during each cycle thereof for slidingly moving the uppermost article rearwardly of said presser member and then moving the same forwardly over said presser member and then upwardly out of engagement with the uppermost article to aid in dispensing the uppermost article from the stack, normally inactive drive means for said pusher means, manually operable means for activating said drive means, and means responsive to activation of said drive means for effecting a cycle in the operation of said pusher means.

5. Apparatus according to claim 1 wherein said article discharge means comprises pusher means normally occupying inactive position spaced from the top of the stack, and linkage means connected to said pusher means, normally inactive drive means drivingly connected to said linkage means, manually operable control means for said drive means, and means responsive to operation of said control means for momentarily activating said drive means for driving said linkage means, and said linkage means being operable to cause said pusher means to move into engagement with the uppermost article in the stack and to slidably move the uppermost article rearwardly out of engagement with said presser member.

6. Apparatus according to claim 1 wherein said article discharge means comprises pusher means normally occupying inactive position spaced from the top of the stack, and linkage means connected to said pusher means, said linkage means comprising plunger means carried by said carriage and adapted for longitudinal forward and rearward movement over the stack of articles, carrier means supported on said plunger means for movement about a pivotal axis extending substantially transversely of said plunger means, said pusher means being connected to said carrier means rearwardly of said pivotal axis, means biasing said plunger means forwardly toward a predetermined inactive position, and thrust means connected to said carrier means at a point above said pivotal axis, normally inactive drive means drivingly connected to said thrust means and arranged so that, upon activation of said drive means, a rearward motion is imparted to said thrust means causing said carrier means and said pusher means to pivot on said pivotal axis until said pusher means engages the uppermost article therebeneath and then causing said plunger means to slidably move the respective article rearwardly out of engagement with said presser member, said drive means also being operable to then release said linkage means, and thus said pusher means, to permit the same to return to inactive positions while releasing the last-named article from said pusher means.

7. Apparatus for dispensing articles such as newspapers, magazines and the like, comprising means for supporting a substantially vertical stack of the articles with the articles inclined downwardly and forwardly, carriage means mounted for substantially vertical movement alongside the forward edges of the articles in the stack, article hold-back means positioned alongside said supporting means and adapted to engage and extend across corresponding forward edges of the articles in the stack to restrain the same from forward sliding movement from the stack, said article hold-back means comprising at least one slide member carried by said carriage means and mounted for vertical movement therewith and having an upper portion adapted to engage the forward edge of at least the uppermost article in the stack to restrain the same from forward sliding movement from the stack, stack height sensing means carried by said carriage means and including at least one presser member adapted to engage and rest upon the uppermost article in the stack and serving for in turn restraining the carriage means against downward movement, and article discharge means carried by said carriage means for engaging the uppermost article in the stack and for slidingly moving the uppermost article rearwardly a predetermined distance out of engagement with said presser member so as to permit said presser member to drop downwardly onto the next article to be dispensed and thereby effect a lowering of said carriage means and said slide member carried thereby to permit gravitationally dispensing the uppermost article over said presser member and said slide member.

* * * * *